US005970682A

United States Patent [19]

Focke et al.

[11] Patent Number: 5,970,682

[45] **Date of Patent: *Oct. 26, 1999**

[54] METHOD AND DEVICE FOR THE MANUFACTURE ESPECIALLY OF HINGE-LID PACKS FOR CIGARETTES

[75] Inventors: Heinz Focke; Martin Stiller, both of Verden, Germany

[73] Assignee: Focke & Co. (GmbH & Co.), Verden, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,615

[22] Filed: Feb. 26, 1997

[30] Foreign Application Priority Data

Feb. 26, 1996 [DE] Germany ..... 196 07 215

[51] Int. Cl.[6] ..... B65B 57/10

[52] U.S. Cl. ..... 53/53; 53/64; 53/389.1; 53/575; 493/12; 493/16

[58] Field of Search ..... 53/53, 54, 64, 53/453, 575, 389.1, 383.1; 493/65, 12, 13, 16

[56] References Cited

U.S. PATENT DOCUMENTS

| | | | |
|---|---|---|---|
| Re. 31,853 | 3/1985 | Vande Castle | 53/53 |
| 2,196,666 | 4/1940 | Moore | 53/575 |
| 3,524,389 | 8/1970 | Stork | 53/53 |
| 3,762,130 | 10/1973 | Davies | 53/53 |
| 4,053,056 | 10/1977 | Day | 53/53 |
| 4,349,998 | 9/1982 | Covert | 53/53 |
| 4,562,687 | 1/1986 | Green | 53/383 |
| 4,634,027 | 1/1987 | Kanarvogel | 220/380 |
| 4,843,798 | 7/1989 | Focke | 53/453 |
| 4,918,908 | 4/1990 | Focke | 53/389.1 |
| 4,976,089 | 12/1990 | Reichelt | 53/53 |
| 4,984,409 | 1/1991 | Focke | 53/53 |
| 5,342,278 | 8/1994 | Kurandt | 493/16 |
| 5,561,970 | 10/1996 | Edie | 53/473 |
| 5,568,715 | 10/1996 | Ebel | 53/54 |

FOREIGN PATENT DOCUMENTS

| | | |
|---|---|---|
| 677444 | 10/1995 | European Pat. Off. . |
| 677444A1 | 10/1995 | European Pat. Off. . |

*Primary Examiner*—Peter Vo
*Assistant Examiner*—James P. Calve
*Attorney, Agent, or Firm*—Sughrue, Mion, Zinn, Macpeak & Seas, PLLC

[57] ABSTRACT

To improve the efficiency of powerful packaging machines for cigarettes or the like, the blanks (10) for wrapping the cigarettes or the like are monitored in respect of correct formation whilst being conveyed along a blanks path (27) to a revolving folding unit (28). Bifurcate photoelectric barriers are positioned on side regions of the blanks path (28) as monitoring units (40, 41). These barriers monitor the state of folding flaps (19. .24), arranged at the side, of the transported blanks (10).

12 Claims, 5 Drawing Sheets

METHOD AND DEVICE FOR THE MANUFACTURE ESPECIALLY OF HINGE-LID PACKS FOR CIGARETTES

BACKGROUND OF THE INVENTION

The invention relates to a method and a device for the manufacture of packs, especially hinge-lid packs for cigarettes, by wrapping the contents of the pack in at least one blank made of paper, thin cardboard or similar packaging material, blanks with individual perforations and folding flaps being led one after the other into a folding unit, especially a revolving folding unit.

The correct design of the blanks being led into the folding units, particularly revolving folding units, is important for the efficiency of a packaging machine. Monitoring, by means of sensors, of blanks which are being transported in the region of a packaging machine is already known in principle. The sensors react to printed marks which are applied to the blanks.

SUMMARY OF THE INVENTION

The purpose underlying the invention is to propose measures to reduce or avoid the occurrence of malfunctions as a result of faulty blanks.

In fulfillment of this purpose, the method according to the invention is characterized by the following features:

a) each individual blank is checked for being correctly formed in its (unfolded) flat state as it is being conveyed and before it is passed into the folding unit, faulty blanks being separated out.

b) as they are being conveyed, the blanks are checked for being correctly formed and for the correct position of the (unfolded) folding flaps by fixed opto-electronic monitoring units with a transmitter and a receiver in the region of folding flaps delimited by punched-out lines and/or fold lines.

Accordingly, in the method according to the invention, spread-out, flat, especially unfolded, individual blanks are checked, whilst being conveyed along a blanks path inside the packaging machine, in respect of being correctly formed in the region of the folding flaps. To this end, the contours of the blanks or the folding flaps are, according to the invention, directly scanned by a monitoring unit which emits a test beam, especially a light beam. This is emitted by a transmitter and picked up by a receiver. The signals picked up by the receiver when a correct blank is scanned are stored in a control unit. If the blank is defective, especially if the folding flaps are incorrectly positioned, the transmitter receives signals which point out the fault. The blank identified in this way is immediately separated out of the flow of blanks being conveyed, i.e. before they are led into the revolving folding unit.

The invention can be applied particularly advantageously to the monitoring of blanks made of thin cardboard for the manufacture of hinge-lid packs. On this type of blank, folding flaps are formed on sides running in the longitudinal direction. According to the invention, these flaps are checked by monitoring units which are positioned stationary on both sides of the path along which the blanks move, in such a way that the test beam or light beam is directed on to the flaps at the side.

A further characteristic feature of the invention consists in a device for separating the faulty blanks out of the region of a path taken by the blanks in such a way that the continuous flow of the blanks towards the revolving folding unit does not have to be interrupted.

Further features of the invention relate to the design of the path taken by the blanks with the monitoring units, to the means of diverting faulty blanks and to the cooperation with a folding unit, operating in the region of the path taken by the blanks, for base-corner flaps of the blank.

An embodiment, given by way of example, of the device according to the invention is described in greater detail below with the aid of the drawings. These show:

DESCRIPTION OF PREFERRED EMBODIMENTS

Figure 1:
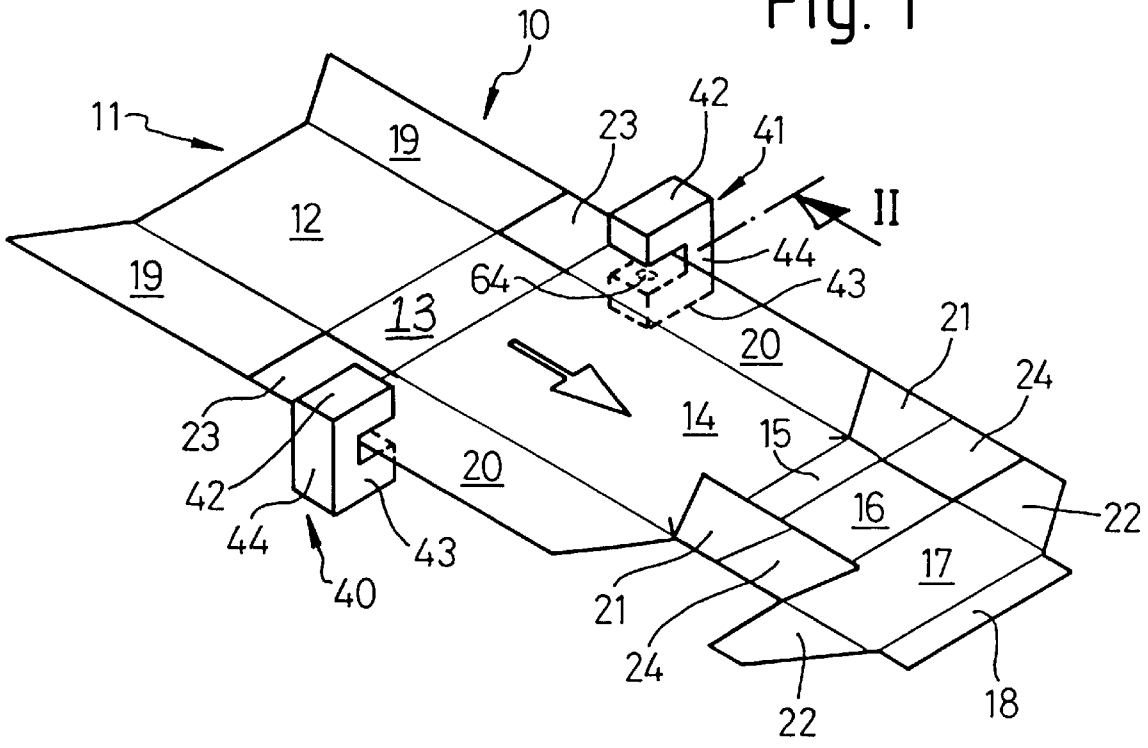
FIG. 1 a view in perspective of a spread-out blank for a folding box (hinge-lid pack) with monitoring units, FIG. 2 a detail from FIG. 1, namely a monitoring unit in side view, on an enlarged scale, FIG. 3 a portion of a packaging machine, namely a region for leading blanks into a folding unit, in diagrammatic side view, FIG. 4 a detail of the device according to FIG. 3, on an enlarged scale, FIG. 5 a cross-section of the device in the cutting plane V—V of FIG. 3, FIG. 6 a further cross-section of the device in the cutting plane VI—VI of FIG. 4.

In the drawings, the manufacture of folding boxes or hinge-lid packs from blanks 10 is shown as a preferred area of application. These blanks 10 consist, in their characteristic form, recognizable in FIG. 1, of thin cardboard.

According to FIG. 1, the blank 10 has an elongated form with a middle portion 11 for forming a front wall 12, a base wall 13 and a rear wall 14. Portions of a lid of the folding box adjoin the latter, namely the rear lid wall 15, end wall 16 and front lid wall 17. An inner flap 18 is connected to the front lid wall 17 and, in the finished box, this flap is folded round towards the inner side of the front lid wall 17 and connected to it by gluing.

A plurality of differently-shaped folding flaps adjoin the middle portion 11 formed in this way. In the present case these are (external) side flaps 19 in the region of the front wall 12 and (inner) side flaps 20 in the region of the rear wall 14. (Inner) lid side flaps 21 adjoin the rear lid wall 15 and (external) lid side flaps 22 adjoin the front lid wall 17. In addition, base corner flaps 23, which are connected to the inner side flaps 20 at the height of the base wall 13, belong to the typical design of a blank 10 for folding boxes. Corresponding lid corner flaps 24 are connected at the height of the end wall 16 with the inner lid side flaps 21. The above-mentioned folding flaps 19 through 24 are divided from one another or from the middle portion 11 by punched-out lines and embossed lines.

The blanks 10 are normally led, pre-formed, into the packaging machine in piles. During manufacture, whilst being conveyed or in additional handling, undesired alterations to the blanks 10 can occur, e.g. undesired folding over of folding flaps or portions of same. In FIG. 1 an example of a fault of this sort is shown through folding over of folding flaps, namely lid side flaps 21 and lid corner flaps 24.

In the present case, the blanks 10 are taken one after the other out of a blanks magazine 25. The lower blank in each case 10 is removed from the blanks magazine by a removing member, here a blanks roller 26, and passed on to a blanks path 27.

The preferably unfolded, flat blank is conveyed along the blanks path 27 with its length pointing in the conveying direction, i.e. with the middle portion 11 lying in the direction of movement corresponding to the arrow in FIG. 1. The blank 10 is here positioned in such a way that the front lid wall 17 or the inner flap 18 lie at the front.

The blanks path 27 extends into the region above a folding unit, namely a revolving folding unit 28. This is designed as a disk which can be moved around a vertical axis, with a plurality of pockets 29 each receiving one blank 10. The blanks path 27 and the revolving folding unit 28 can correspond in the important parts to the embodiment according to US 4 084 393. Accordingly, the flat blank 10 is transported through the blanks path 27 into a position above a pocket 29 of the revolving folding unit 28 and pressed from above by a pressing plate 30 into the open pocket 29. In this process, folding flaps are brought into an upright position. The blank 10 adopts an L-shaped form in longitudinal section, the base wall 13 and the front wall 12 forming an upright leg with the side folding flaps arranged thereon.

The folding flaps 19 through 24 extend as they are being conveyed at the side inside the blanks path 27. Upper and lower guide walls 31, 32 serve as guide members. The blank 10 is transported in a gap between them.

As transport means, a plurality of feed cylinders are provided, disposed at suitable distances from one another and which, as pairs of cylinders 33, 34 and 35, grasp the blanks above and below as they are being transported. The cylinders of these pairs of cylinders 33, 34 and 35 are designed in such a way that a plurality of cylinder disks 38 are arranged on a common shaft 36 or the journal 37 of a shaft. These disks move from above and below through the guide walls 31, 32 in the region of slits 39 and grasp the blank 10 respectively from above and below.

In the conveying direction the pairs of cylinders 33, 34, 35 are arranged at such distances from one another that at least one pair of cylinders always grasps a blank 10 and moves it along.

As they are being conveyed in the region of the blanks path 27, the blanks 10 are checked to see that they are in the correct state. For this purpose, testing or monitoring units 40, 41 are, in the present example, arranged on both longitudinal sides of the blanks path 27. The monitoring units 40, 41 are in each case equipped with sensors, namely a transmitter 63 and a receiver 64. A test beam 65, especially a light beam, goes out from the transmitter 63 and is picked up by the receiver 64. The blanks 10 are conveyed between the transmitter 63 and receiver 64 with the result that the test beam 65 is, for example, directed from above on to the blank 10, in the region of the side folding flaps 19, 20, 21, 22, 23, 24.

In the present embodiment, given by way of example, the monitoring units 40, 41 are designed as so-called bifurcate photoelectric barriers. They consist of upper and lower legs 42, 43 directed horizontally and an upright web 44 joining these legs with one another. The legs 42, 43 extend above and below the blanks 10 when the latter are being moved past the monitoring units 40, 41. The sensors, namely the transmitter 63 and receiver 64, are arranged in the legs 42, 43, the transmitter 63 being positioned in the present case above the path of movement of the blanks 10. The test beam 65 running between the transmitter 63 and receiver 64 is temporarily interrupted by the blanks 10 or by the folding flaps 19 through 24. If the blanks are correctly formed, there is a certain sequence of interruptions to the light barrier. If, however, folding flaps are not lying in the correct position—as in the embodiment, given by way of example and shown here—the light beam is temporarily released again during the movement of the blank. In this way, a faulty blank 10 is identified. A control signal effects the removal of the relevant blank 10 from the region of the blanks path 47.

In the present embodiment, given by way of example, the control units, namely the monitoring units 40, 41, are positioned directly after the first pair of cylinders 33. Accordingly, checking for faults takes place at the beginning of the blanks path 27.

A normal gluing device 45 is arranged in the further course of the blanks path and above same. This device has the task of applying gluing marks on certain, selected regions of the blank 10 as it is being conveyed. In the region of the blanks path 27, therefore, the blank has its printed side facing downwards and its inner side facing upwards. The control means of the gluing device 45 can, in the present case, be so designed that no glue is applied to blanks 10 identified as faulty. In this embodiment, the control signal derived from the monitoring units 40, 41 is also passed on to the gluing device 45.

The faulty blanks 10 are separated out before they reach the revolving folding unit 28, i.e. are moved out of the blanks path 27. For this purpose, a diverting means is installed after the (third) pair of cylinders 35 to separate out a faulty blank before it reaches the revolving folding unit 28. The faulty blank is then carried away on a conveying track 46, in the present case into a collecting receptacle 47. At least one pair of cylinders 48 is allocated to the conveying track 46 to carry away the blank 10 which has been separated out.

The diverting means is formed on the present embodiment, given by way of example, by a track plate 49. This is mounted so as to be movable above the blanks path 27. The upper guide wall 31 of the blanks path 27 is recessed, or not continued, in this region, with the result that the track plate 49 moves by a swinging motion downwards until it is lying on the lower guide wall 32 when a faulty blank can be separated out. A ramp 50 of the track plate 49 lies here on the guide wall 32, in a groove 51 formed in the latter. In this way, steady continuation of the guide wall 32 into the track plate 49 lying on it comes about.

On the side facing the ramp 50, the track plate 49 leads directly into the conveying track 46.

The track plate 49 is mounted here as a one-armed lever and can be moved by means of a transverse axle 52 mounted on one or both sides. One end of this axle 52 is mounted on a carrying wall 53 of the packaging machine.

The track plate 49 can be moved up and down or pivoted by a pressure medium cylinder 54. The pressure medium cylinder 54, for its part, is connected pivotally with the carrying wall 53. A piston rod 55 directed downwards is connected with the track plate 49, via an actuating rod 56 directed sideways. The drive for the track plate 49 is, accordingly, arranged off-centre to the blanks path 27 and thus no reciprocal disturbances can occur.

A first folding unit 57 for the blank 10 is allocated to the blanks path 27. This unit is a plate-shaped body with a recess 58. The latter is so arranged and is of such dimensions that the blanks path 27 runs through the recess 58. A lower delimitation of the recess 58 consists of folding fingers 59, 60 lying opposite one another. These enter the movement region of the blanks 10 from both sides, outside the middle portion 11.

Figure 2:
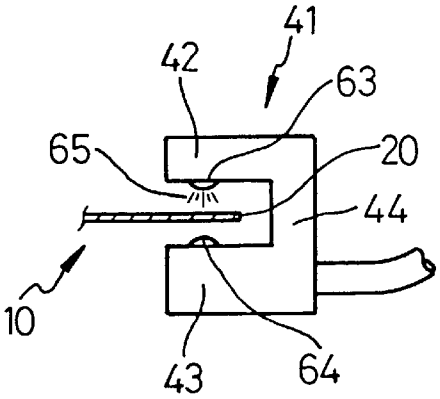
Figure 3:
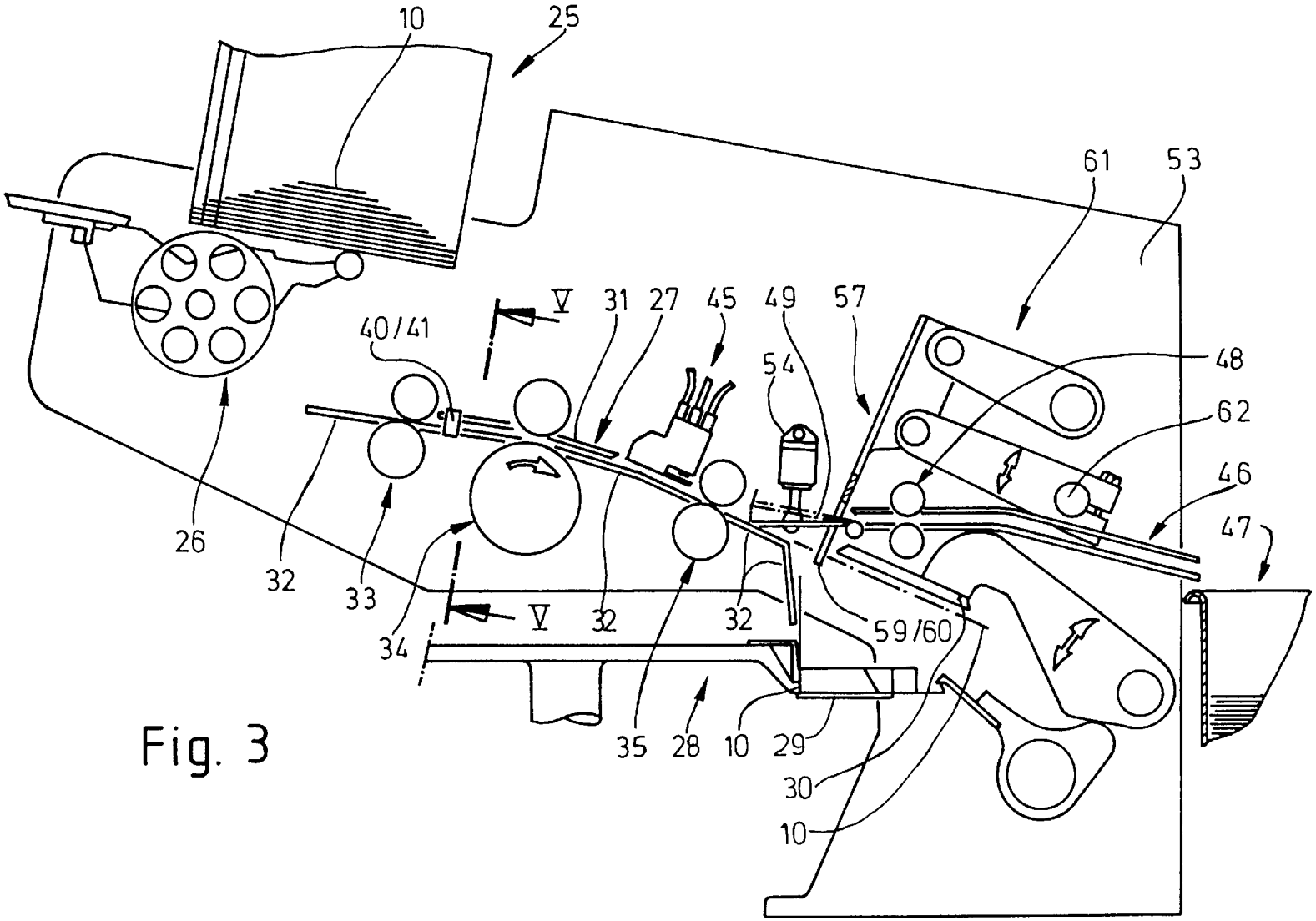
Figure 4:
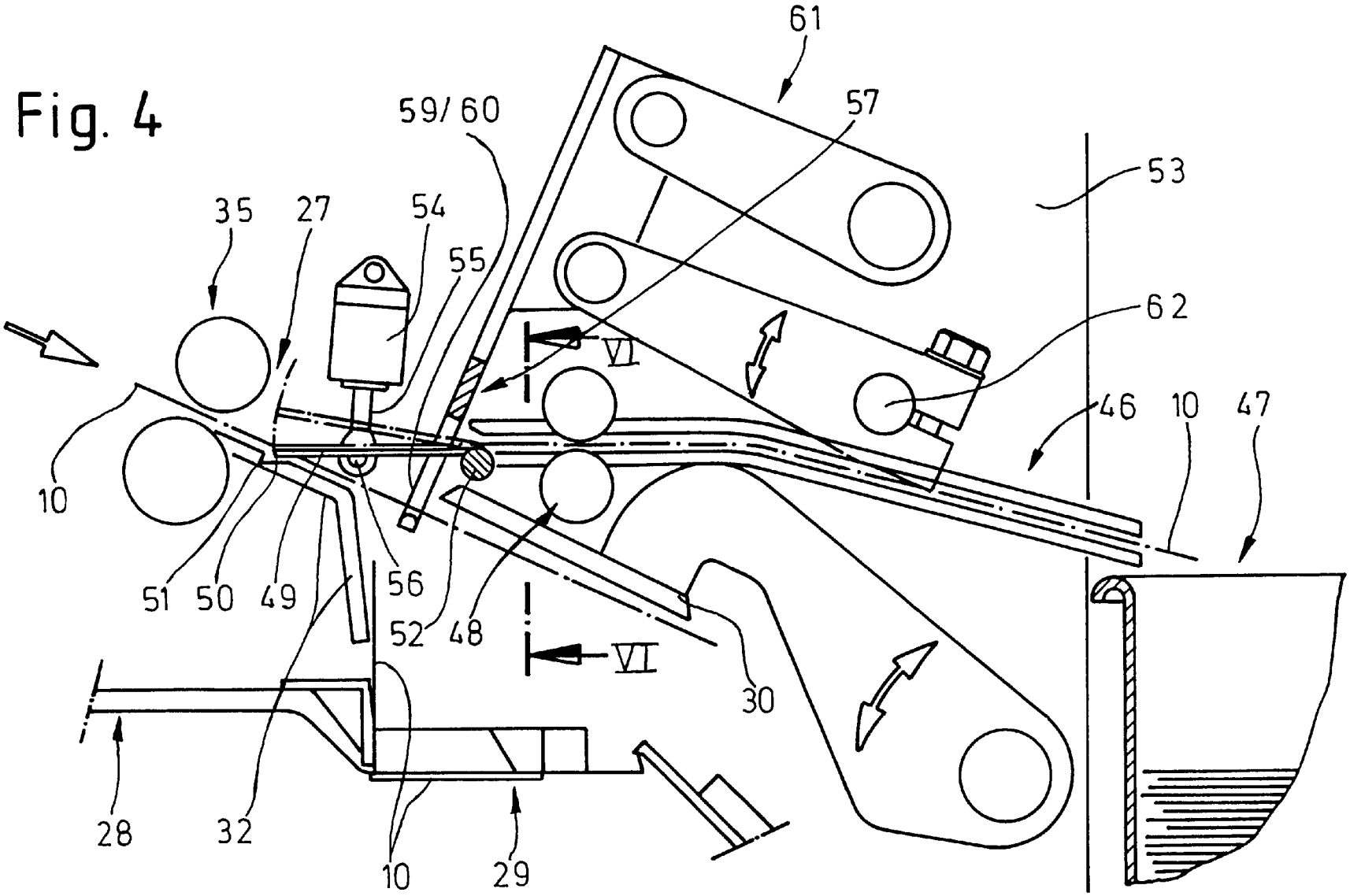
Figure 5:
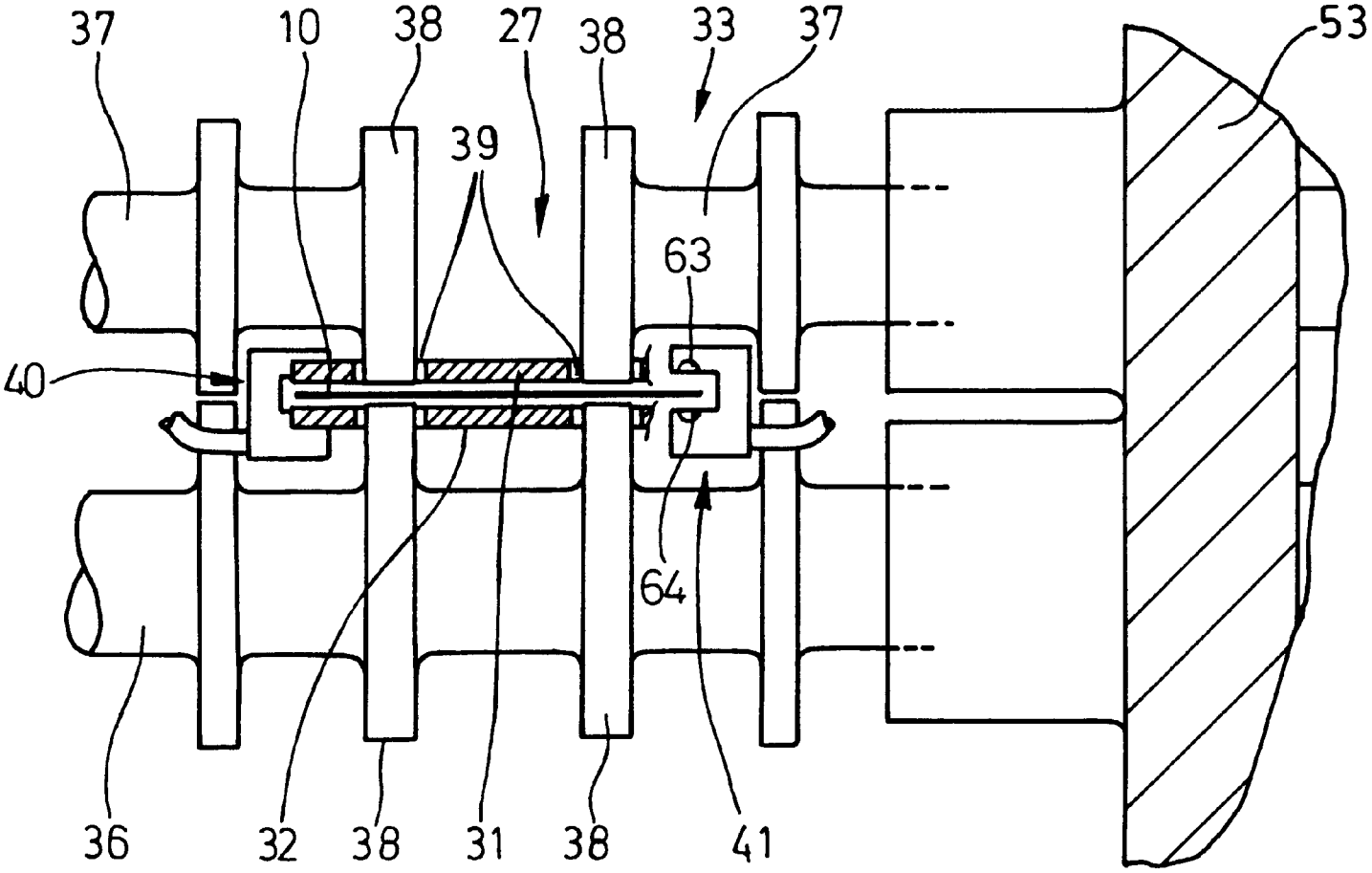
Figure 6:
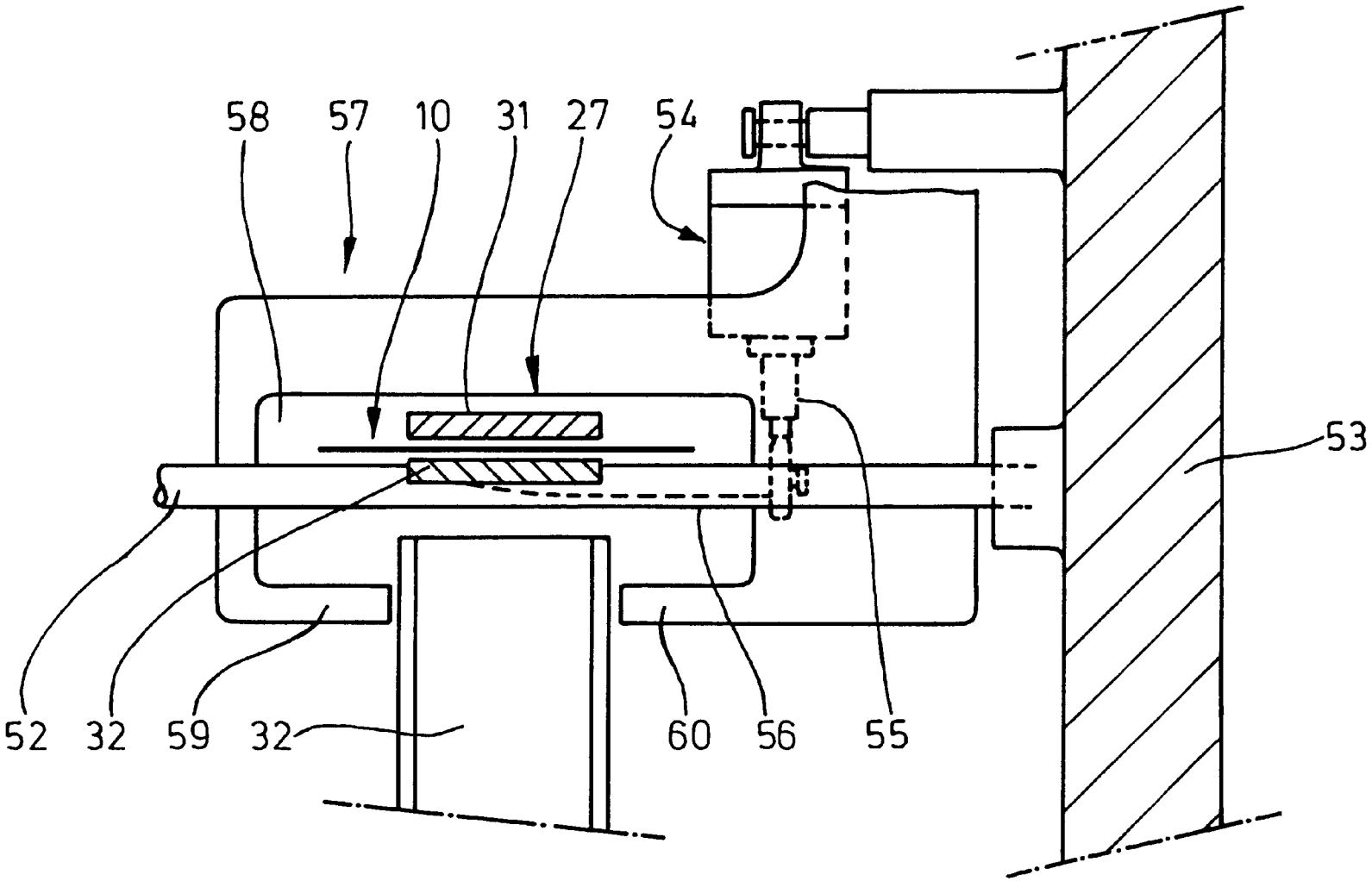

The folding fingers 59, 60 have the task of bringing the base edge flaps 23 into a partially upright intermediate folding position. To this end, the folding fingers 59, 60 are positioned during a stationary phase of the blank 10 in the region of the base corner flaps 23 below the blank 10. By means of an upward movement of the folding unit 57 and thus of the folding fingers 59, 60, the base edge flaps 23 are moved into an inclined intermediate folding position, pointing upwards. To carry out this folding step, the folding unit 57 can be moved up and down, into an inclined folding plane. The folding unit 57 is mounted, for this purpose, on a parallelogram linkage 61 which can be moved up and down via an actuating shaft 62 in the direction of the arrow (FIG. 2 and FIG. 3).

The folding unit 57 is positioned in such a way that the track plate 49 lies in the region of same. The track plate 49 is led through the recess 58 which is of correspondingly larger dimensions. In this way, the optimal relative positions of the conveying means and the folding units are produced.

Once the base corner edge 23 has been folded in the end position of the blank 10 in the region of the blanks path 27, the blank is moved upwards by the pressing plate 30 into the pocket 29 of the revolving folding unit 28.

Checking the blanks 10 in respect of correct formation can also be extended to other regions or folding flaps. In addition, the control means can be so designed that they can also monitor other external aspects of the blank 10, for instance its imprinting (pointing downwards).

Instead of the shown form of embodiment of the monitoring units 40, 41 with transmitters 63 and receivers 64 positioned above and below the path of movement of the blanks 10, those monitoring units which work on the principle of reflection can also be used. In this case, transmitter and receiver are arranged in a common holder, for instance above the movement path of the blanks. By means of the reflection of the light, faults are likewise identified in the manner described.

What is claimed is:

1. A device for manufacturing hinge-lid packs for cigarettes by wrapping the contents of each pack in at least one blank made of thin cardboard or similar packaging material, wherein individual blanks have folding flaps defined along edges of the blanks by punching or fold lines, wherein said folding flaps include side flaps (19, 20), lid side flaps (21, 22), base corner flaps (23) and lid corner flaps (24), and wherein said blanks are fed one after another along a blanks path (27) into a folding unit (28), said device comprising:

a) means for feeding the elongated blanks (10) in a longitudinal conveying direction along the blanks path in an unfolded, flat state, with their length extending in the conveying direction in such a way that the folding flaps (19 to 24) lie in a position transversely directed with respect to the conveying direction and are successive in the conveying direction;

b) in a region of the blanks path (27), opto-electronic monitoring units (40, 41) for monitoring the unfolded blanks (10) and providing a control signal indicative of presence and a correctness of formation of the folding flaps (19 to 24), c) wherein said monitoring units (40, 41) are located on both sides of the blanks path (27) and monitor the successive folding flaps (19 to 24) on both sides of the blanks (10), and d) wherein each monitoring unit (40, 41) defines a photoelectric barrier which comprises a transmitter (63) and receiver (64), said transmitter transmitting a test light beam (65) which is directed to said receiver and at the blank (10) in a region of the folding flaps (19 to 24) and which is picked up by the receiver (64);

e) conveying means, responsive to said control signal, for separating, and conveying out of the blanks path, incorrect blanks (10) exhibiting missing or incorrectly formed folding flaps; and f) an upper guide member (31) and a lower guide member (32), between which the folding flaps of the blanks (10) are conveyed, g) wherein the upper guide member (31) and the lower guide member (32) comprise guide walls extending along the blanks path (27) in the conveying direction, and wherein breaks in the upper guide member (31) and lower guide member (32) allow the monitoring units (40, 41) to pass through, and h) wherein the distance between the upper guide member (31) and the lower guide member (32) is less than the distance between the transmitter (63) and the receiver (64) of the photoelectric barrier.

2. The device according to claim 1, wherein the monitoring units (40, 41) are bifurcate photoelectric barriers and are positioned, stationary and facing one another, along the blanks path (27) in a region of the side flaps (19 to 24), said device further comprising means for moving the blanks (10), with their side flaps (19 to 24), between legs (42, 43) of the bifurcate barriers, so that the folding flaps (19 to 24) temporarily interrupt the test light beam directed from said transmitter (63) to said receiver (64).

3. The device according to claim 2, further comprising: a blanks magazine (25); and means for removing the blanks (10) one after the other from the blanks magazine (25) and feeding them into the blanks path (27) directly adjoining the blanks magazine (25), the bifurcate photoelectric barriers being positioned in a region of the blanks path (27) which slopes down at an angle in the conveying direction.

4. The device according to claim 1, further comprising, located in the blanks path (27), a gluing unit (45) which applies glue marks onto selected areas of the correct blanks (10) during the feeding thereof, wherein said conveying means first removes incorrect blanks (10) from the blanks path (27) in an area thereof located downstream of the gluing unit (45) in the conveying direction.

5. The device according to claim 4, wherein said gluing unit is controlled by said control signal so as not to apply glue marks to incorrect blanks (10).

6. The device according to claim 1, further comprising:

in the region of the blanks path (27) following the monitoring units (40, 41) in the conveying direction, a movable track plate (49) which is in a position for separating out an incorrect blank (10) and which projects at an angle into a movement path of the blanks (10) in such a way that the incorrect blank (10) is pushed by a conveying movement of the blanks onto the track plate (49), and is directed by the track plate (49) out of the region of the blanks path (27); and means for causing said track plate (49) to assume a different position in which it does not project into the movement path of the blanks (10) and thus allows the correct blanks (10) to be conveyed to the folding unit (28).

7. The device according to claim 6, wherein the track plate (49) has a free lower ramp (50), is pivotally mounted above the blanks path (27), and is adapted to be lowered until said ramp (50) lies on a lower guide wall (32) of the blanks path (27) to divert an incorrect blank.

8. The device according to claim 6, further comprising a first folding unit (57) for the blanks (10), wherein the track plate (49) is located in a region of said first folding unit (57), said first folding unit (57) being of a wall- or plate-like design and having a recess (58) through which both the blanks path (27) and the track plate (49) can pass, and wherein said first folding unit has folding fingers (59, 60) that are formed as a lower limit of the recess (58), and that are movable relative to the blank (10) to fold the base corner flaps (23) from a lower initial position into an intermediate position.

9. The device according to claim 1, further comprising means for moving the blanks (10) at the end of the blanks path (27) downwardly into pockets (29) of the folding unit (28).

10. The device according to claim 1, wherein:

a) the breaks in the upper guide (31) and lower guide (32) are in a region of pairs (33, 34, 35) of rollers;

b) the roller pairs (33, 34, 35) have upper and lower roller disks (38) which project through the upper and lower guides (31, 32) from above and below, and grasp the blanks (10) from above and below, respectively; and c) said upper and lower roller disks (38) are spaced at a distance from one another which is less than the distance between the upper guide (31) and the lower guide (32).

11. The device according to claim 1, further comprising:

a track plate (49) located above the blanks path (27) downstream of the monitoring units (40, 41) and at an oblique angle to the blanks path (27); and means for moving the separated incorrect blanks onto the track plate (49).

12. The device according to claim 11, wherein said means for moving comprises a conveying track (46) connected to the track plate (49).

* * * * *